US008870425B2

(12) United States Patent
Furukawa et al.

(10) Patent No.: US 8,870,425 B2
(45) Date of Patent: Oct. 28, 2014

(54) LAMP BODY AND VEHICLE LAMP BODY UNIT

(75) Inventors: Michio Furukawa, Utsunomiya (JP); Hitoshi Aoki, Utsunomiya (JP); Koji Fukura, Utsunomiya (JP); Daisen Kojima, Utsunomiya (JP); Naoki Akita, Tokorozawa (JP); Taku Saito, Tokyo (JP); Hidemi Tanaka, Tokyo (JP); Seiji Hasegawa, Tokyo (JP); Kosuke Shiohama, Tokyo (JP)

(73) Assignees: Honda Motor Co., Ltd, Tokyo (JP); Stanley Electric Co., Ltd., Tokyo (JP)

( * ) Notice: Subject to any disclaimer, the term of this patent is extended or adjusted under 35 U.S.C. 154(b) by 227 days.

(21) Appl. No.: 13/494,322

(22) Filed: Jun. 12, 2012

(65) Prior Publication Data

US 2012/0327677 A1 Dec. 27, 2012

(30) Foreign Application Priority Data

Jun. 21, 2011 (JP) ..... 2011-137686

(51) Int. Cl.
*F21V 7/09* (2006.01)
*F21S 8/10* (2006.01)
*F21V 5/04* (2006.01)

(52) U.S. Cl.
CPC ..... *F21S 48/1154* (2013.01); *F21S 48/1394* (2013.01); *F21S 48/1388* (2013.01); *F21S 48/1305* (2013.01); *F21S 48/1329* (2013.01)
USPC ..... 362/517; 362/518; 362/520; 362/522

(58) Field of Classification Search
USPC ..... 362/543–549
See application file for complete search history.

(56) References Cited

U.S. PATENT DOCUMENTS 7,460,985 B2 12/2008 Benitez et al.
2004/0252390 A1* 12/2004 Benitez et al. ..... 359/858
2008/0316761 A1* 12/2008 Minano et al. ..... 362/518

FOREIGN PATENT DOCUMENTS

CN 1550223 A 12/2004
CN 2709779 Y 7/2005

(Continued)

OTHER PUBLICATIONS

Chinese Office Action with partial English translation, Application No. 201210199654.2, dated Jan. 6, 2014, 7 pages.

(Continued)

*Primary Examiner* — Karabi Guharay
*Assistant Examiner* — Nathaniel Lee
(74) *Attorney, Agent, or Firm* — Rankin, Hill & Clark LLP

(57) ABSTRACT

In a lamp body, a second reflective surface, which reflects light reflected from a first reflective surface to a front side again so as to emit the light toward the front side, is formed on a back surface of a lens main body; fixing portions protrude outward from an outer peripheral portion of the lens main body and are fixed to a seating section; the first reflective surface is formed in a shape of a band which extends in one direction and of which both end portions reach the outer peripheral portion of the lens main body; constricted portions, which are recessed inward, are formed at the outer peripheral portion of the lens main body near at least one of the both end portions of the first reflective surface; and the fixing portions are disposed in the constricted portions.

16 Claims, 9 Drawing Sheets

(56) References Cited

FOREIGN PATENT DOCUMENTS

| | | | |
|---|---|---|---|
| CN | 1734159 | A | 2/2006 |
| JP | 63-15501 | | 2/1988 |
| JP | 2005-011704 | | 1/2005 |
| JP | 2010-262779 | | 11/2010 |
| JP | 2011-100692 | | 5/2011 |

OTHER PUBLICATIONS

Notice of Allowance, date of mailing Apr. 1, 2014. English Translation Included.

* cited by examiner

LAMP BODY AND VEHICLE LAMP BODY UNIT

FIELD OF THE INVENTION

The present invention relates to a lamp body and a vehicle lamp body unit including a plurality of lamp bodies.

Priority is claimed on Japanese Patent Application No. 2011-137686, filed Jun. 21, 2011, the content of which is incorporated herein by reference.

RELATED ART

A lamp body including an optical lens 110, which is disposed on the front side of a light source 100 such as an LED and emits light emitted from the light source 100 toward the front side as shown in FIGS. 11 and 12, is known as this kind of lamp body (for example, see Patent Document 1).

The optical lens 110 is formed of a lens which has a predetermined thickness and of which the outline has a substantially rectangular shape in plan view. Reflective surfaces 120 are formed on a part of the front surface and the back surface of the optical lens 110, respectively. For this reason, after being reflected by the reflective surface 120 formed on the front surface, light emitted from the light source 100 is further reflected by the reflective surface 120 formed on the back surface. Then, the light is emitted toward the front side.

Further, since two mounting pieces 130 protrude outward from each of both edge portions of the optical lens 110 in the width direction of the optical lens, it is possible to fix the optical lens 110 by total of four mounting pieces 130.

REFERENCE DOCUMENTS

Patent Documents

[Patent Document 1] U.S. Pat. No. 7,460,985

SUMMARY OF THE INVENTION

Problems to be Solved by the Invention

Meanwhile, in the optical lens 110 in the related art, the mounting pieces 130, which are used to fix the optical lens 110, protrude from both the outer edge portions of the optical lens 110 in the width direction, respectively. For this reason, the length of the optical lens in the width direction is increased by how much these mounting pieces 130 protrude outward, so that the size of the optical lens is apt to increase.

Further, there is a case where the plurality of optical lenses generally disposed side by side are used. However, when the plurality of optical lenses 110 are disposed side by side in the width direction, the optical lenses 110 should be disposed at intervals so that the mounting pieces 130 of the respective optical lenses 110 do not come into contact with each other. For this reason, a gap is formed between the adjacent optical lenses 110, so that the appearance deteriorates and the design is poor.

Furthermore, since the mounting pieces 130 protrude outward from both the outer edge portions of the optical lens 110, the appearance deteriorates and the design is poor even in this regard. Since the mounting pieces 130 also need to be hidden even if the optical lens 110 itself is covered with and hidden by a decorative cover member to improve the design, the size of the cover member is increased. For this reason, a large cover member should be used, so that design is once again poor.

The invention has been made in consideration of the above-mentioned problems, and an object of the invention is to provide a lamp body that is compact and excellent in design and a vehicle lamp body unit that includes a plurality of lamp bodies.

Methods for Solving the Problem

In order to achieve the object, each of the aspects of the invention has the following structure.

(1) A lamp body according to an aspect of the invention, includes: a light source; a lens body that is disposed on a front side of the light source; and a seating section that is disposed on a back side of the lens body and where the light source is mounted and the lens body is fixed, wherein: the lens body comprises a lens main body and fixing portions; a first reflective surface, which reflects light emitted from the light source to the back side, is formed on a part of a front surface of the lens main body; a second reflective surface, which reflects the light reflected from the first reflective surface to the front side again so as to emit the light toward the front side, is formed on a back surface of the lens main body; the fixing portions protrude outward from an outer peripheral portion of the lens main body and are fixed to the seating section; the first reflective surface is formed in a shape of a band which extends in one direction and of which both end portions reach the outer peripheral portion of the lens main body; constricted portions, which are recessed inward, are formed at the outer peripheral portion of the lens main body near at least one of the both end portions of the first reflective surface; and the fixing portions are disposed in the constricted portions.

(2) In the lamp body according to the above (1), the lens main body may includes a first lens portion and a second lens portion that are disposed on both sides of the first reflective surface, and the first reflective surface may be orthogonal to an imaginary line that connects a central portion of the first lens portion with a central portion of the second lens portion.

(3) The lamp body according to the above (1) or (2) may further include an annular cover member that is fitted to the lens body from the front side and covers the outer peripheral portion of the lens main body and the fixing portions.

(4) In the lamp body according to the above (3), the cover member may include a cover body that overlaps the first reflective surface and covers at least a part of the first reflective surface.

(5) In the lamp body according to the above (4), the cover body may be formed in the shape of a protrusion that protrudes toward a middle portion of the lens main body and is directed to the middle portion.

(6) A vehicle lamp body unit according to another aspect of the invention includes, a plurality of the lamp bodies according to any one of the above (1) to (5), a plurality of the lamp bodies are disposed in a vehicle width direction, and each of the lamp bodies is disposed so that an extension direction of the first reflective surface is parallel to the vehicle width direction.

Effects of the Invention

According to the invention of the above (1), it is possible to extensively emit the light, which is emitted from the light source, forward while making the light pass through the other portions of the front surface other than the first reflective surface. Therefore, it is possible to obtain excellent irradiation performance.

In particular, light, which spreads mainly in a direction orthogonal to the extension direction of the first reflective surface, of the light emitted from the light source is reflected by the first and second reflective surfaces. This light is used as irradiation light that is emitted toward the front side. On the other hand, light, which spreads in the extension direction of the first reflective surface, of the light emitted from the light source becomes light that is difficult to use as the irradiation light.

Meanwhile, the fixing portions, which fix the lens body to the seating section, protrude from the outer peripheral portion of the lens main body and are disposed in the constricted portions that are formed at the outer peripheral portion. For this reason, since it is possible to reduce as far as possible the length of the fixing portions themselves that protrude outward, it is easy to make the lens body compact by reducing the size of the lens body. Further, since the fixing portions are disposed in the constricted portions, the fixing portions are not very conspicuous. Accordingly, since the fixing portions not very conspicuous, it is possible to improve the design.

Furthermore, the constricted portions are formed at the outer peripheral portion of the lens main body near end portions of the first reflective surface. For this reason, the constricted portions hardly affect the light (light used as the irradiation light), which spreads in a direction orthogonal to the extension direction of the first reflective surface, of the light emitted from the light source. Meanwhile, the constricted portions are positioned on the optical path of the light, which spreads in the extension direction of the first reflective surface, of the light emitted from the light source. However, the light is light that is difficult to use as the irradiation light as described above.

Accordingly, even though the constricted portions are formed, it is possible to form the lamp body that hardly affects light distribution performance, can emit light with a desired amount of light and light distribution performance, and has excellent irradiation performance.

According to the invention of (2), it is possible to dispose the first lens portion, the second lens portion, and the first reflective surface in balance. For this reason, appearance is good and it is possible to improve design. Further, since it is easy to evenly emit light from the respective first and second lens portions that are disposed on both sides of the first reflective surface, it is possible to form a lamp body having an excellent light distribution balance.

According to the invention of (3), since it is possible to hide the fixing portions and the outer peripheral portion of the lens main body with the cover member, it is possible to further improve design.

According to the invention of (4), since it is possible to further hide at least a part of the first reflective surface with the cover body, it is possible to further improve the design. Further, since the cover body overlaps the first reflective surface, it is possible to improve the design without affecting light distribution performance.

According to the invention of (5), since it is possible to cause the cover body to have design property, for example, a design property that calls to mind the setting which holds the stone portion of a ring, it is possible to further improve the design.

According to the invention of (6), the plurality of lamp bodies can be arranged side by side so as to be close to each other in the vehicle width direction. For this reason, it is possible to form a vehicle lamp body unit which can be installed in a small space and is excellent in design and of which the appearance is good. In addition, since each of the lamp bodies is an excellent lamp body having a desired amount of light and light distribution performance, the entire unit can have high irradiation performance and may be preferably used as, for example, a headlight.

DETAILED DESCRIPTION OF THE INVENTION

An embodiment of the invention will be described below with reference to the drawings.

Meanwhile, in this embodiment, a case where a vehicle lamp body unit is applied to a headlight of a vehicle will be described by way of example.

Figure 1:
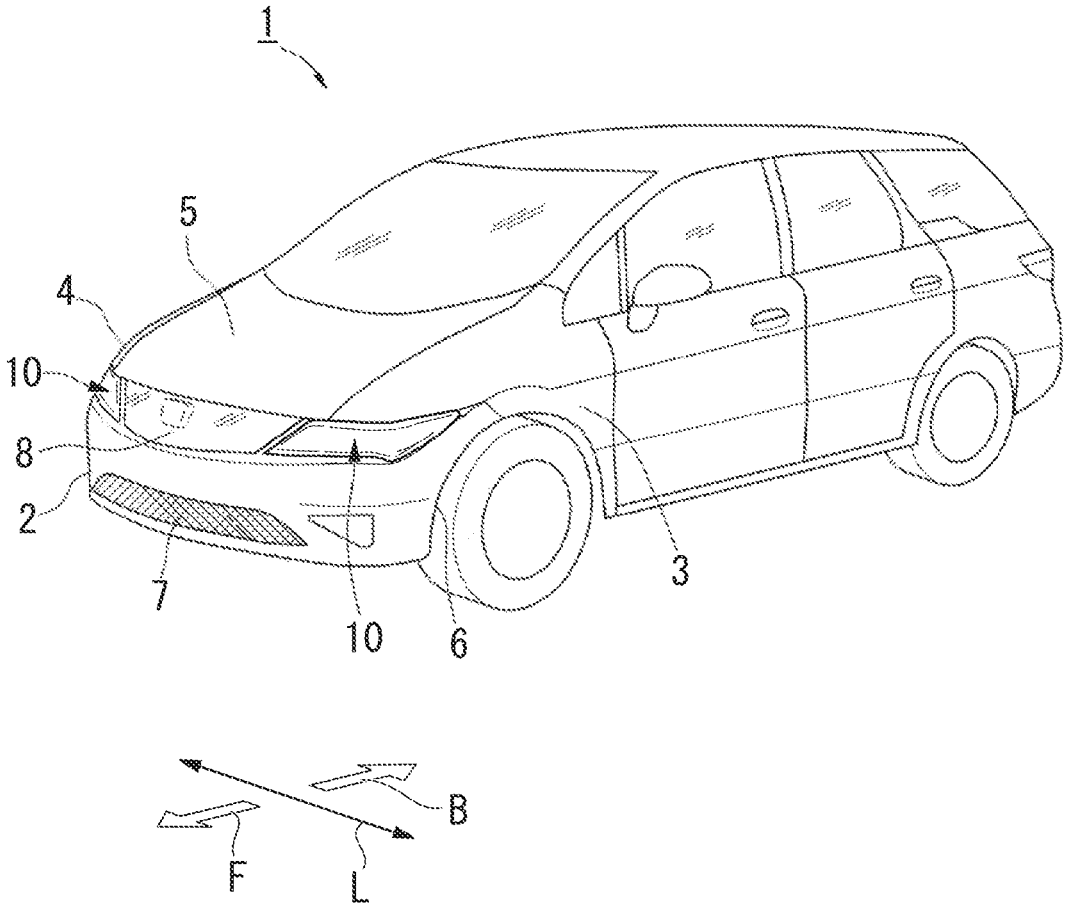
FIG. 1 is a perspective view of the appearance of a vehicle, which includes headlights (vehicle lamp body units) according to an embodiment of the invention, when seen from the front side.

As shown in FIG. 1, the front portion of a vehicle body 1 of a vehicle is covered with a front bumper 2, left and right fender panels 3 and 4, a hood 5, and the like. Both left and right ends of the front bumper 2 are formed so as to come around to wheel arches 6, and a grille 7 through which traveling wind is introduced into an engine room (not shown) is provided at the lower portion of the front surface of the front bumper 2.

A front garnish 8 is installed above the front bumper 2 between the front bumper 2 and the hood 5 at the middle portion in the vehicle width direction (L), and left and right headlights (vehicle lamp body units) 10 are installed between the fender panels 3 and 4 and the hood 5 on both sides in the vehicle width direction (L).

Meanwhile, in this embodiment, the longitudinal direction, the horizontal direction, and the vertical direction are defined on the basis of the orientation of the vehicle shown in FIG. 1.

The above-mentioned headlights 10 will be described in detail. Here, the left and right headlights are symmetric with each other. Since the headlights have the same structure, the left headlight 10 will be described in detail and the description of the right headlight 10 will be omitted.

(Structure of Headlight)

Figure 2:
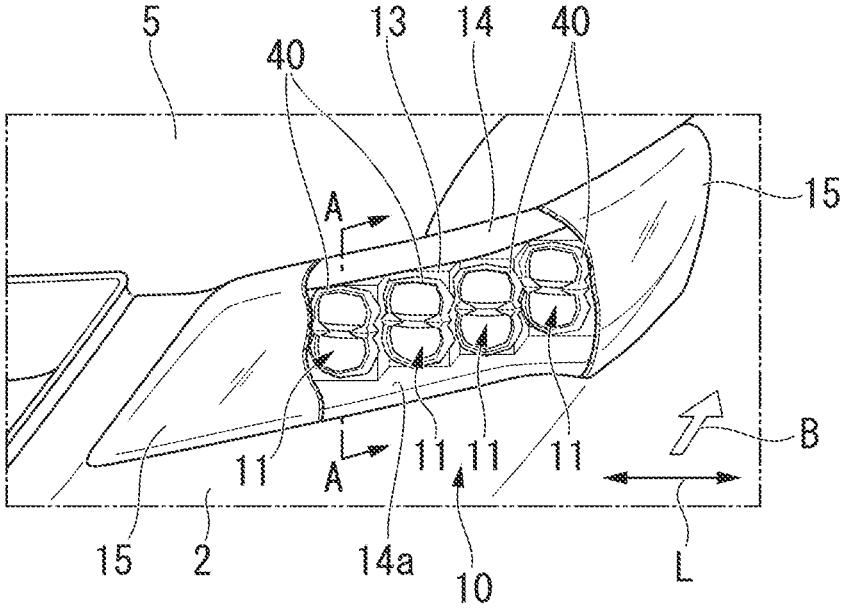
FIG. 2 is an enlarged view of a left headlight shown in FIG. 1.
Figure 3:
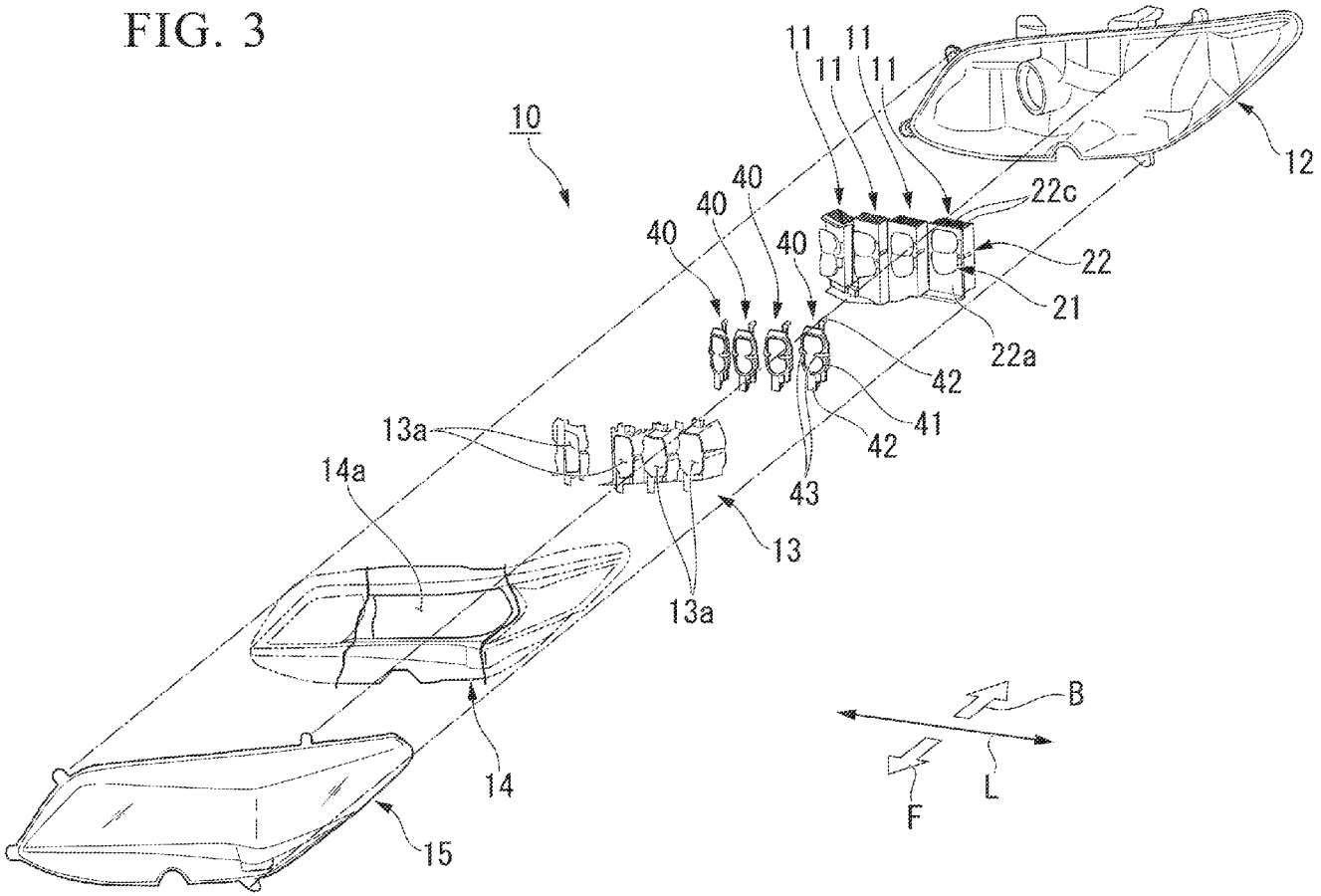
FIG. 3 is an exploded perspective view of the headlight shown in FIG. 2.
Figure 4:
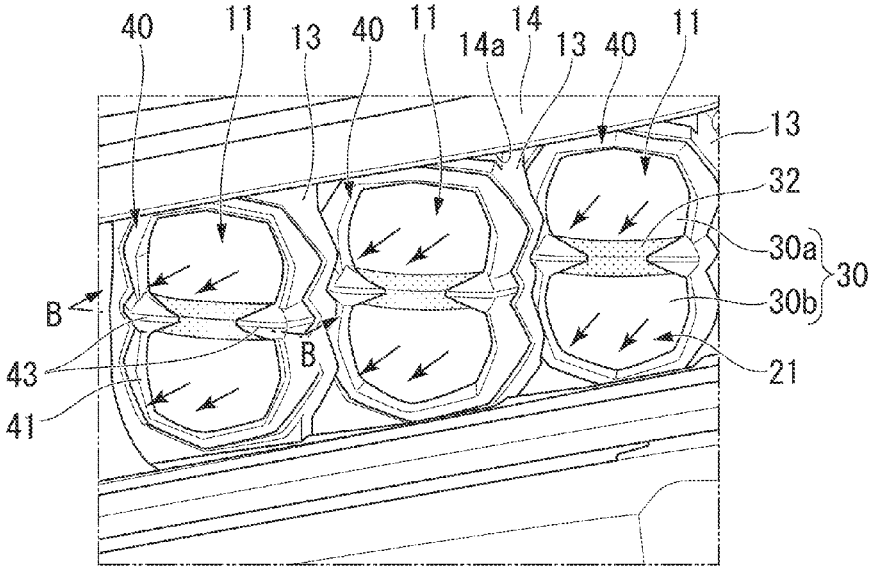
FIG. 4 is an enlarged view of lamp bodies of the headlight shown in FIG. 2.
Figure 5:
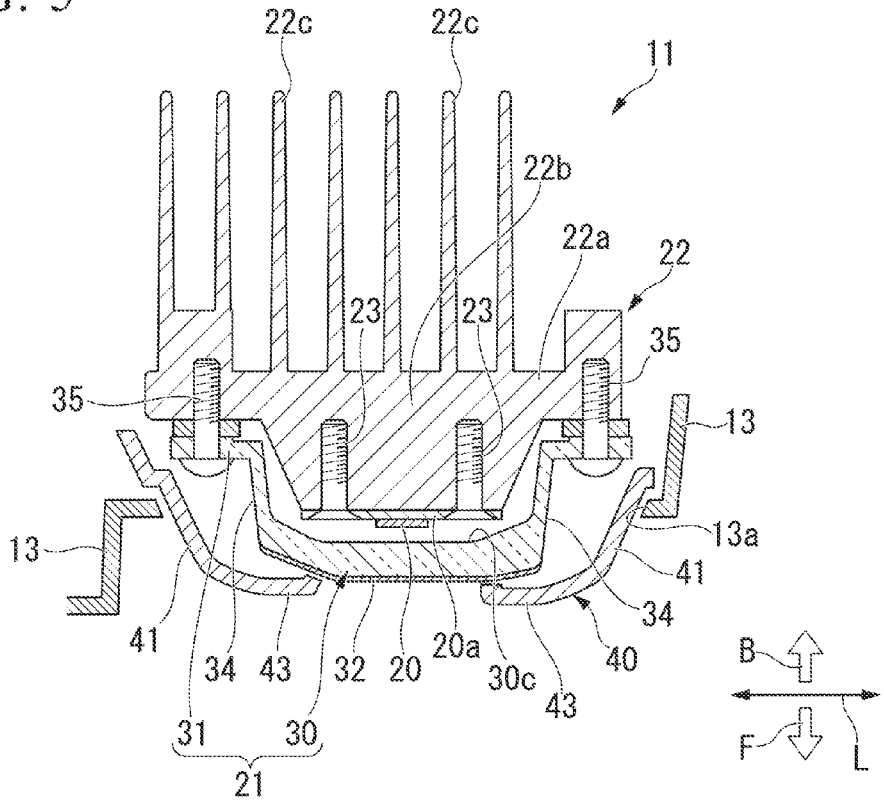
FIG. 5 is a cross-sectional view of the lamp body, which is shown in FIG. 4, taken along line B-B.

As shown in FIGS. 2 to 4, the headlight 10 includes four lamp bodies 11 that are disposed side by side in the vehicle width direction (L), a housing 12 on which these four lamp bodies 11 are mounted, decorative covers 13 that are fitted to these lamp bodies 11 from the front side (F), a reflector 14 that is fitted to the housing 12 from the front side (F) of the decorative covers 13, and a lens cover 15 that is fitted to the housing 12 from the front side (F) of the reflector 14.

The housing 12 is a molded component made of, for example, metal or a resin, and is mounted on a vehicle body frame member (not shown), such as a front bulkhead, a wheel house member, or a bulkhead side frame that is provided at the front portion of the vehicle body 1.

Meanwhile, in addition to the above-mentioned four lamp bodies 11, a side indicator light source that emits light for indicating a direction, a high beam light source that emits light for a high beam, and the like are fixed to the housing 12 by mounting members. However, the side indicator light source, the high beam light source, and the like are not described and not shown here.

As shown in FIG. 2, the four lamp bodies 11 are to emit light for a low beam in this embodiment, are disposed side by side in the vehicle width direction (L) as described above, and are disposed so that the positions of the lamp bodies 11 are shifted in stages to the back side (B) toward the outside (left side) of the vehicle body 1 to follow the shape of the front bumper 2. Further, each of the lamp bodies 11 is disposed so that the extension direction of a first reflective surface 32 to be described below is parallel to the vehicle width direction (L).

As shown in FIGS. 3 to 6, each of the lamp bodies 11 includes a light source 20 that is formed of an LED or the like, a lens body 21 that is disposed on the front side (F) of the light source 20, and a fixing module (seating section) 22 which is disposed on the back side (B) of the lens body 21 and where the light source 20 is mounted and the lens body 21 is fixed.

The fixing module 22 includes a base plate 22*a*. The base plate 22*a* is made of metal, and is formed in the shape of a plate that is long in the vertical direction and short in the horizontal direction. The base plate 22*a* is fixed to the above-mentioned housing 12 by well-known fixing means (not shown). A bulging portion 22*b*, which bulges toward the front side (F) and has a trapezoidal shape in longitudinal cross-sectional view, is formed at the middle portion of the base plate 22*a* in the vertical direction. Further, a light source plate 20*a* to which the light source 20 is fixed is mounted on the end face of the bulging portion 22*b*. In the embodiment shown in the drawings, the light source plate 20*a* is fixed by screws 23. However, the light source plate 20*a* may be fixed by adhesion.

Moreover, a plurality of fins 22*c* protrude toward the back side (B) from the base plate 22*a*. These fins 22*c* extend along the base plate 22*a* in the vertical direction, and are disposed side by side at intervals in the horizontal direction. Accordingly, heat, which is radiated by the light source 20, can be radiated efficiently, so that a temperature rise in the light source 20 is prevented. In this way, it is possible to make the fixing module 22 function as a heat sink.

Meanwhile, the fins 22*c* are not essential and the fixing module 22 may not be made to function as a heat sink. Further, the light source 20 is electrically connected to a light source control unit (not shown) mounted on the housing 12, so that the operation of the light source 20 is controlled by a signal output from the light source control unit.

The lens body 21 is a member that is made of an optical material. As shown in FIGS. 4 to 8, the lens body 21 includes a lens main body 30 that covers the light source 20 from the front side (F), and mounting pieces (fixing portions) 31 that protrude outward from the outer peripheral portion of the lens main body 30 and are fixed to the front surface of the base plate 22*a* of the fixing module 22.

A first reflective surface 32, which reflects light emitted from the light source 20 to the back side (B), is formed on a part of the front surface of the lens body 21. A second reflective surface 33, which reflects the reflected light to the front side (F) again so as to emit the light toward the front side (F), is formed on the back surface of the lens body 21.

Examples of the first and second reflective surfaces 32 and 33 include a metal film that is formed by, for example, deposition or sputtering.

The first reflective surface 32 is formed in the shape of a band, which extends in the vehicle width direction (L), at the middle portion of the lens body 21 in the vertical direction. Both end portions of the first reflective surface 32 in the longitudinal direction reach the outer peripheral portion of the lens main body 30.

Further, a portion of the lens main body 30, which is positioned above the first reflective surface 32, is an upper lens portion (first lens portion) 30*a*, and a portion of the lens main body 30, which is positioned below the first reflective surface 32, is a lower lens portion (second lens portion) 30*b*.

That is, the upper and lower lens portions 30*a* and 30*b* of the lens main body 30 of this embodiment are disposed on both the upper and lower sides of the first reflective surface 32. Furthermore, in plan view, the first reflective surface 32 is formed in a direction (vehicle width direction (L)) orthogonal to an imaginary line O (see FIG. 8), which connects the central portion of the upper lens portion 30*a* with the central portion of the lower lens portion 30*b*.

Moreover, a receiving recess 30*c*, which is recessed toward the front side (F), is formed on the back surface of the lens main body 30 at the portion positioned on the back side (B) of the first reflective surface 32. Further, the lens body 21 is disposed on the front side (F) of the fixing module 22 so that the bulging portion 22*b* of the base plate 22*a* is received in the receiving recess 30*c*. Accordingly, light emitted from the light source 20 can efficiently enter the first reflective surface 32 of the lens body 21.

Furthermore, constricted portions 34, which are recessed inward, are formed at the outer peripheral portion of the lens main body 30 near both end portions of the first reflective surface 32 in the longitudinal direction. For this reason, the outline of the lens main body 30 of this embodiment is formed in the shape of "8" (the shape of a gourd) in plan view.

Further, a portion of the front surface of the lens main body 30 where the first reflective surface 32 is formed is recessed in a V shape in cross-sectional view. Accordingly, the thickness of the lens main body 30 is the largest at the portion where the first reflective surface 32 is formed together with the above-mentioned receiving recess 30*c* (see FIG. 6).

The above-mentioned mounting pieces 31 are disposed at the constricted portions 34 that are formed at the right and left portions of the outer peripheral portion of the lens body 21, respectively. These mounting pieces 31 are fixed to the base plate 22*a* of the fixing module 22 by fixing screws 35. Accordingly, the entire lens body 21 is strongly fixed to the fixing module 22.

Meanwhile, as shown in FIGS. 3 to 6, each of the lamp bodies 11 of this embodiment includes an annular ring cover (cover member) 40 that is fitted to the base plate 22*a* of the fixing module 22 from the front side (F) of the lens body 21 and covers the outer peripheral portion of the lens main body 30 and the mounting pieces 31 disposed at the constricted portions 34.

An injection-molded article is plated with a metal material such as aluminum by deposition after the injection molding of, for example, a resin, so that the ring cover 40 is preferably finished as a decorative cover.

The ring cover 40 includes a ring portion 41 that covers and hides the outer peripheral portion of the lens main body 30 and the mounting pieces 31; locking pieces 42 that protrude upward and downward from the upper and lower end portions of the ring portion 41, respectively, and lock the ring portion 41 to the base plate 22*a*; and two claw portions (cover bodies) 43 that are formed integrally with the ring portion 41 and overlap the first reflective surface 32 of the lens main body 30.

The ring portion 41 is formed so as to follow the outline of the lens body 21, so that an opening formed in the ring portion is also formed in the shape of "8" in plan view. Accordingly, the upper and lower lens portions 30*a* and 30*b* of the lens body 21 are exposed to the front side (F) without being hidden by the ring portion 41.

The claw portions 43 are formed in the shape of protrusions that protrude toward a middle portion of the lens main body 30 while covering the first reflective surface 32 from the left and right of the ring portion 41 and are directed to the middle portion. In the embodiment shown in the drawings, the claw portions 43 are formed so as to protrude in the shape of a triangular pyramid.

As shown in FIG. 3, the respective fixing modules 22 of the four lamp bodies 11 having the above-mentioned structure are arranged side by side in the vehicle width direction (L) while being connected integrally with each other. Meanwhile, the invention is not limited to this case and the respective fixing modules 22 may be separated from each other. However, the embodiment shown in the drawings is preferable due to the fact that the fixing modules are easily mounted on the housing 12, the optical axes of the respective lamp bodies 11 are easily adjusted so as to be identical to each other, and the like.

As shown in FIGS. 3 to 6, each of the decorative covers 13 is fitted to the fixing module 22 from the front side (F) of the lens body 21 to which the ring cover 40 is fitted. An injection-molded article is plated in a desired color (black or the like) after the injection molding of, for example, a resin, so that the decorative cover 13 is preferably finished as a hiding member.

An opening portion 13*a* through which the claw portions 43 and the ring portion 41 of the above-mentioned ring cover 40 are exposed to the outside is formed at the decorative cover 13. For this reason, it is possible to further hide the locking pieces 42 of the ring cover 40 by fitting the decorative cover 13.

As shown in FIGS. 2 to 4, the reflector 14 is a member that is fitted to the housing 12 from the front side (F) of the decorative covers 13. An injection-molded article is plated with a metal material such as aluminum by deposition after the injection molding of, for example, a resin, so that the reflector 14 is formed. Further, the outline of the reflector 14 has the same shape as the shape of the housing 12. An opening portion 14*a* through which the lens main bodies 30 including the upper and lower lens portions 30*a* and 30*b*, the ring portions 41 and the claw portions 43 of the ring covers 40, and a part of the decorative covers 13 are exposed to the front side (F) is formed at the middle portion of the reflector 14.

Meanwhile, receiving chambers (not shown) in which the above-mentioned side indicator light source and high beam light source are received on both the left and right sides of the opening portions 13*a* are formed at the reflector 14. A reflective film, which is plated by the deposition of a metal material such as aluminum and reflects light emitted from the side indicator light source and the high beam light source, is formed on the inner wall surfaces of these receiving chambers.

The lens cover 15 is a member that is fitted to the housing 12 from the front side (F) of the decorative cover 13. The lens cover 15 is formed by the injection-molding of, for example, an optically transparent material and covers the entire reflector 14.

(Function of Headlight)

Next, a case where the headlight 10 having the above-mentioned structure is used will be described.

Figure 6:
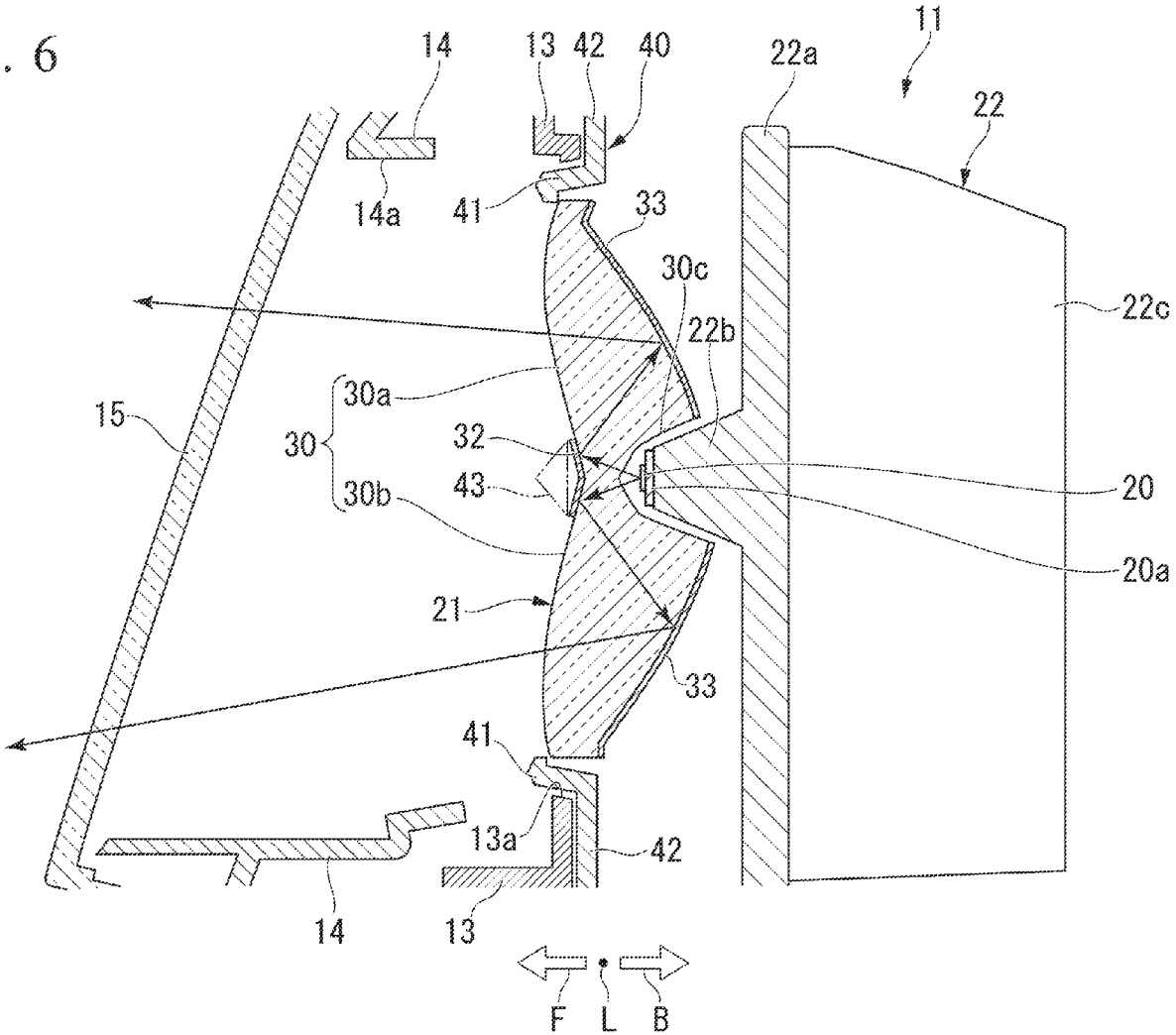
FIG. 6 is a cross-sectional view of the lamp body, which is shown in FIG. 2, taken along line A-A.

When a driver performs an operation for emitting a low beam during driving, the light source control unit activates the light source 20 of each of the lamp bodies 11. Then, after entering the lens main body 30 as shown in FIG. 6, light emitted from the light source 20 is reflected by the first reflective surface 32 and is reflected again by the second reflective surface 33. Accordingly, it is possible to extensively emit this light toward the front side (F) while making this light pass through the other portions of the front surface of the lens main body 30 except for the first reflective surface 32. Therefore, it is possible to form a low beam having excellent irradiation performance.

In particular, light, which spreads mainly in the vertical direction (a direction orthogonal to the extension direction of the first reflective surface 32), of the light emitted from the light source 20 is reflected by the first and second reflective surfaces 32 and 33. This light is used as irradiation light that is emitted toward the front side (F). Moreover, in this case, it is possible to evenly emit the light, which spreads in the vertical direction as shown in FIGS. 4 and 6, from the respective upper and lower lens portions 30*a* and 30*b* that are disposed on both the upper and lower sides of the first reflective surface 32. For this reason, it is possible to form a low beam having excellent light distribution balance.

Meanwhile, light, which spreads in the horizontal direction, that is, the extension direction of the first reflective surface 32, of the light emitted from the light source 20 is light that is difficult to use as the irradiation light.

Figure 8:
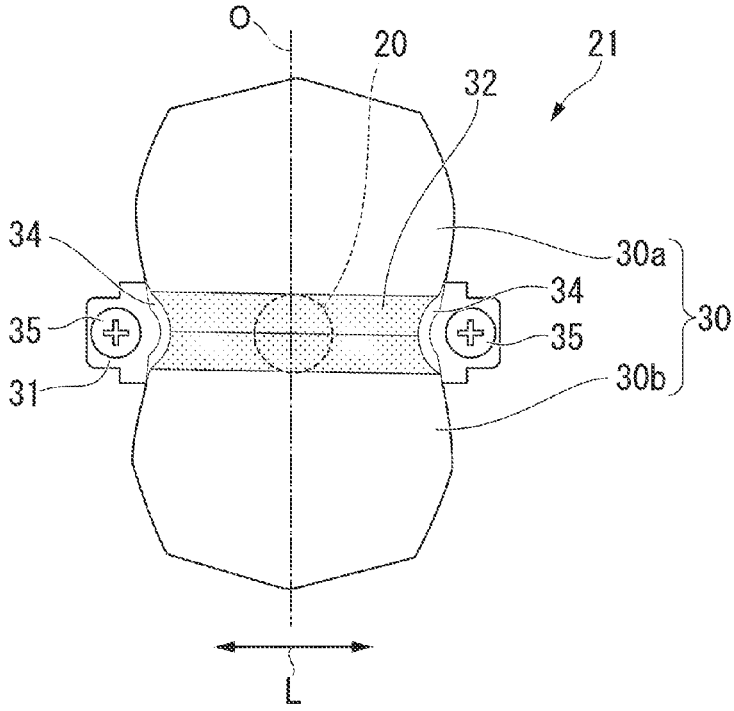
FIG. 8 is a front view of the lens body shown in FIG. 7.

Further, as shown in FIG. 8, the constricted portions 34 of each of the lamp bodies 11 are formed at the outer peripheral portion of the lens main body 30 near both end portions of the first reflective surface 32 in the longitudinal direction. For this reason, the constricted portions 34 hardly affect the light, which spreads in the vertical direction and is used as the irradiation light, of the light emitted from the light source 20. Meanwhile, the constricted portions 34 are positioned on the optical path of the light, which spreads in the horizontal direction, of the light emitted from the light source 20. However, the light is light that is difficult to use as the irradiation light as described above.

Accordingly, even though the constricted portions 34 are formed, it is possible to form the lamp body 11 that hardly affects light distribution performance, can emit light with a desired amount of light and light distribution performance, and has excellent irradiation performance.

Further, as shown in FIG. 2, the four lamp bodies 11 can be arranged side by side so as to be close to each other in the vehicle width direction (L). For this reason, it is possible to form the headlight 10 which can be installed in a small space and is excellent in design and of which the appearance seen through the lens cover 15 is good.

This will be described in detail.

Figure 7:
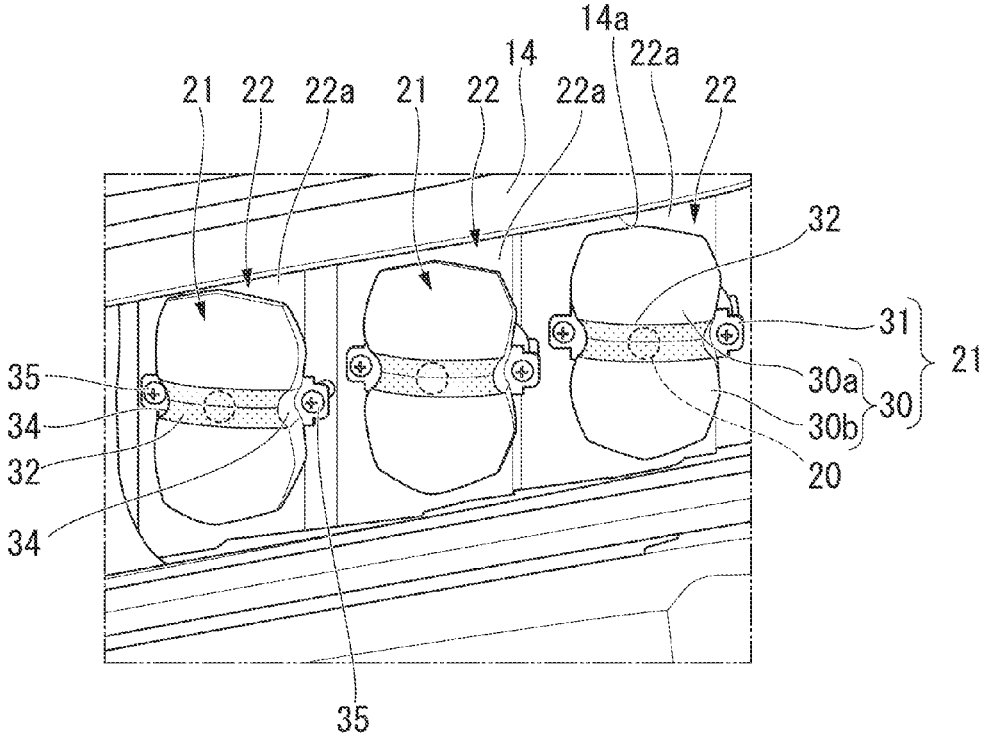
FIG. 7 is a view showing a state where ring covers and decorative covers are detached from a state shown in FIG. 4 and lens bodies are mounted.

As shown in FIGS. 7 and 8, the mounting pieces 31, which fix the lens body 21 to the fixing module 22, protrude from the outer peripheral portion of the lens main body 30 but are disposed in the constricted portions 34 that are formed at the outer peripheral portion. For this reason, since it is possible to reduce as far as possible the length of the mounting pieces 31 themselves that protrude outward, it is easy to make the lens body 21 compact by reducing the size of the lens body 21. Accordingly, without affecting the mounting pieces 31, it is possible to dispose the lens main bodies 30 of the respective lamp bodies 11 so that the lens main bodies 30 are close to each other.

Therefore, it is possible to obtain the above-mentioned functional effect.

Further, the upper and lower lens portions 30*a* and 30*b* of the lens main body 30 of each of the lamp bodies 11 are disposed on both the upper and lower sides of the first reflective surface 32 in balance, and the first reflective surface 32 is formed in the vehicle width direction (L). For this reason, even in this regard, the lamp body has good appearance and is excellent in design.

Furthermore, as shown in FIG. 4, the outer peripheral portion of each of the lamp bodies 11 and the mounting pieces 31 are hidden by the ring cover 40 and the locking pieces 42 of the ring cover 40 are also hidden by the decorative cover 13. For this reason, even in this regard, the lamp body has a good appearance and is excellent in design.

Moreover, since the claw portions 43 of the ring cover 40 are formed in the shape of protrusions that protrude toward the middle portion of the lens main body 30, it is possible to obtain a design property that calls to mind, for example, the setting which holds the stone part of a ring. For this reason, it is possible to ensure excellent design. In addition, since the claw portions 43 overlap the first reflective surface 32, it is possible to expect an optical illusion as though the first reflective surface 32 were a part of a design. For this reason, it is also possible to expect a remarkable design together with the first reflective surface 32.

Meanwhile, since the claw portions 43 overlap the first reflective surface 32, it is possible to obtain the above-mentioned functional effect without affecting the light distribution performance.

Further, it is possible to expect a visual effect through various color scheme balances by combining the respective colors of the lens body 21, the ring cover 40, the decorative cover 13, and the reflector 14. Even in this regard, it is possible to improve design.

Meanwhile, the scope of the invention is not limited to the above-mentioned embodiment, and may be modified in various ways without departing from the gist of the invention.

For example, in the above-mentioned embodiment, a case where four lamp bodies 11 are arranged side by side in the vehicle width direction (L) so as to be applied to the headlight 10 of the vehicle has been described by way of example. The invention is not limited to the headlight 10.

Further, when the lamp bodies 11 are applied to the headlight 10, the number of the lamp bodies 11 is not limited to four and may be two, three, or five or more.

Further, the lamp body 11 may be used alone. In this case, even though the lamp body does not include the ring cover 40, the mounting pieces 31 are not very conspicuous since the mounting pieces 31 are disposed in the constricted portions 34. Accordingly, it is possible to improve the design of the lamp body 11.

Furthermore, in the above-mentioned embodiment, the constricted portions 34 have been formed at the left and right, that is, two positions on the outer peripheral portion of the lens body 21, respectively. However, the number of constricted portion 34 may be formed only one. That is, the constricted portion 34 may be formed near one of both end portions of the first reflective surface 32 in the longitudinal direction.

Figure 9:
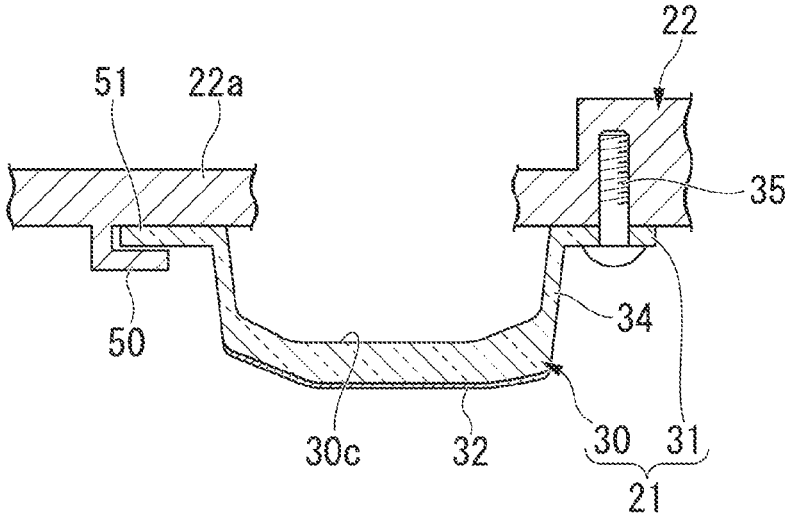
FIG. 9 is a view showing a modification of the embodiment and is a cross-sectional view showing a state where a lens body is fixed by another method.
Figure 10:
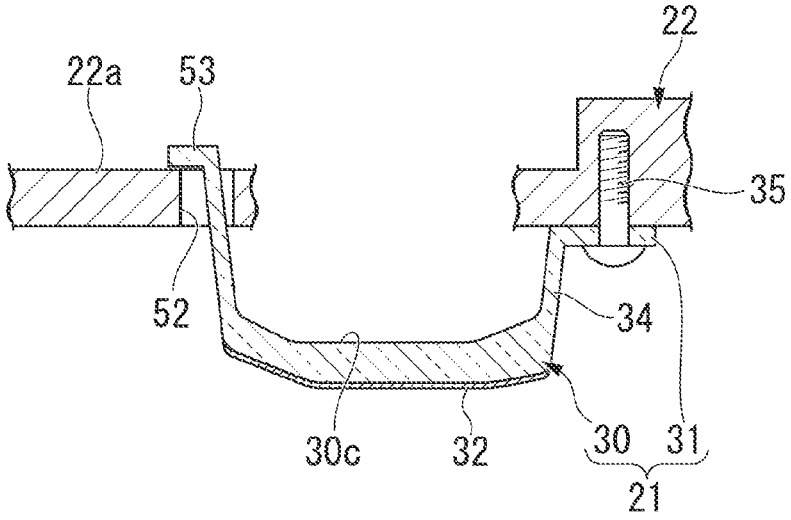
FIG. 10 is a view showing another modification of the embodiment and is a cross-sectional view showing a state where a lens body is fixed by still another method.
Figure 11:
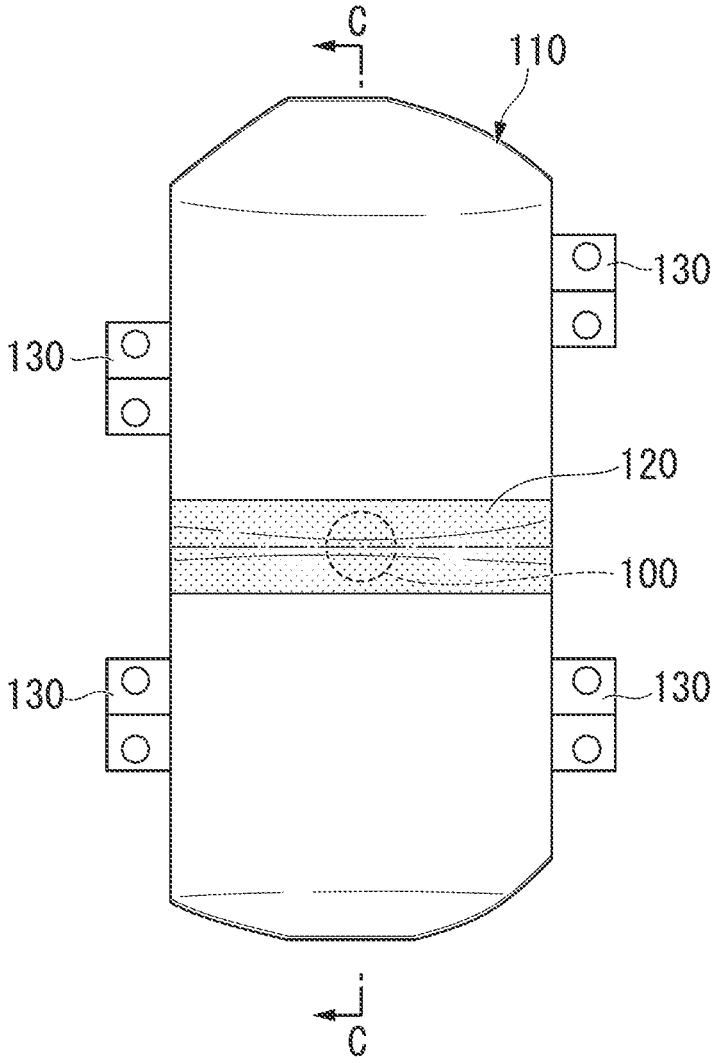
FIG. 11 is a front view showing an example of an optical lens in the related art.
Figure 12:
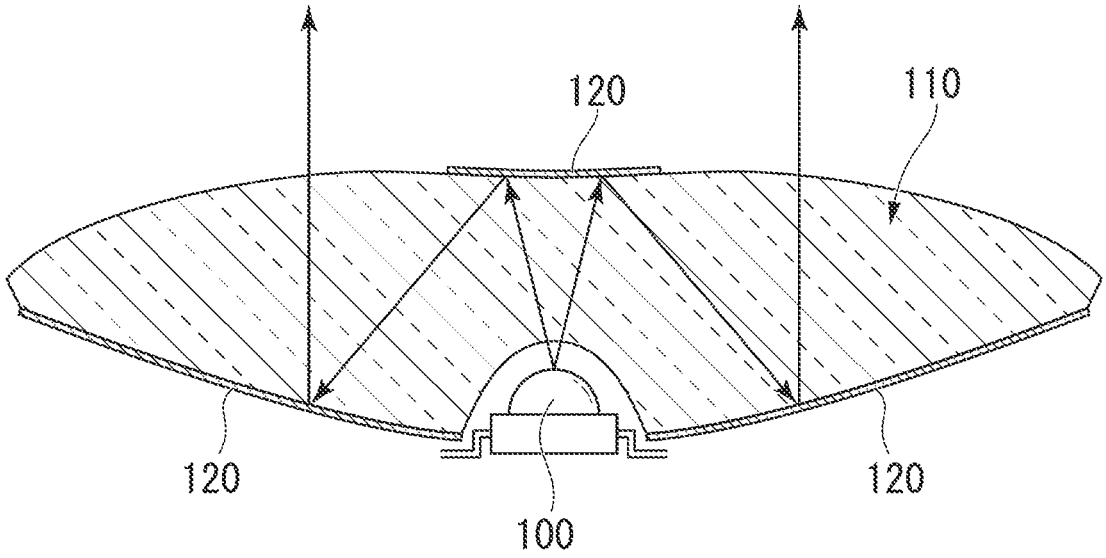
FIG. 12 is a cross-sectional view of the optical lens, which is shown in FIG. 11, taken along line C-C.

In this case, for example, as shown in FIG. 9, a protruding plate 51, which is inserted and bumps into a locking groove 50 formed on the base plate 22*a* of the fixing module 22, is formed at a portion of the lens main body 30 opposite to the mounting piece 31. Alternatively, a hook portion 53, which is caught in a through hole 52 formed at the base plate 22*a* of the fixing module 22, may be formed as shown in FIG. 10. In this way, it is possible to strongly fix the lens body 21. Further, in these cases, it is possible to obtain the same functional effect.

INDUSTRIAL APPLICABILITY

According to the lamp body of the invention, it is possible to easily make the lamp body compact, and to emit light with a desired amount of light and light distribution performance while improving the design by improving the appearance.

REFERENCE SYMBOL LIST

1 imaginary line
1 vehicle body
2 front bumper
3 left fender panel
4 right fender panel
5 hood
6 wheel arche
7 grille
8 front garnish
10 headlight (vehicle lamp body unit)
11 lamp body
12 housing
13 decorative cover
13*a* opening portion
14 reflector
14*a* opening portion
15 lens cover
20 light source
20*a* light source plate
21 lens body
22 fixing module (seating section)
22*a* base plate
22*b* bulging portion
22*c* fin
23 screw
30 lens main body
30*a* upper lens portion (first lens portion)
30*b* lower lens portion (second lens portion)
30*c* receiving recess
31 mounting piece (fixing portion)
32 first reflective surface
33 second reflective surface
34 constricted portion
35 fixing screw
40 ring cover (cover member)
41 ring portion
42 locking piece
43 claw portion (cover body)
50 locking groove
51 protruding plate
52 through hole
53 hook portion
100 light source
110 optical lens
120 reflective surface
130 mounting piece

The invention claimed is:

1. A lamp body comprising:

a light source;

a lens body that is disposed on a front side of the light source; and a seating section that is disposed on a back side of the lens body and where the light source is mounted and the lens body is fixed, wherein:

the lens body comprises a lens main body and fixing portions;

a first reflective surface, which reflects light emitted from the light source to the back side, is formed on a part of a front surface of the lens main body;

a second reflective surface, which reflects the light reflected from the first reflective surface to the front side again so as to emit the light toward the front side, is formed on a back surface of the lens main body;

the fixing portions protrude outward from an outer peripheral portion of the lens main body and are fixed to the seating section;

the first reflective surface is formed in a shape of a band which extends in one direction and of which both end portions reach the outer peripheral portion of the lens main body;

constricted portions, which are recessed inward, are formed at the outer peripheral portion of the lens main body near at least one of the both end portions of the first reflective surface; and the fixing portions are disposed in the constricted portions.

2. The lamp body according to claim 1, wherein the lens main body comprises a first lens portion and a second lens portion that are disposed on both sides of the first reflective surface, and the first reflective surface is orthogonal to an imaginary line that connects a central portion of the first lens portion with a central portion of the second lens portion.

3. The lamp body according to claim 2, further comprising an annular cover member that is fitted to the lens body from the front side and covers the outer peripheral portion of the lens main body and the fixing portions.

4. The lamp body according to claim 3, wherein the cover member comprises a cover body that overlaps the first reflective surface and covers at least a part of the first reflective surface.

5. The lamp body according to claim 4, wherein the cover body is formed in the shape of a protrusion that protrudes toward a middle portion of the lens main body and is directed to the middle portion.

6. A vehicle lamp body unit comprising a plurality of the lamp bodies according to claim 5, wherein a plurality of the lamp bodies are disposed in a vehicle width direction, and each of the lamp bodies is disposed so that an extension direction of the first reflective surface is parallel to the vehicle width direction.

7. A vehicle lamp body unit comprising a plurality of the lamp bodies according to claim 4, wherein a plurality of the lamp bodies are disposed in a vehicle width direction, and each of the lamp bodies is disposed so that an extension direction of the first reflective surface is parallel to the vehicle width direction.

8. A vehicle lamp body unit comprising a plurality of the lamp bodies according to claim 3, wherein a plurality of the lamp bodies are disposed in a vehicle width direction, and each of the lamp bodies is disposed so that an extension direction of the first reflective surface is parallel to the vehicle width direction.

9. A vehicle lamp body unit comprising a plurality of the lamp bodies according to claim 2, wherein a plurality of the lamp bodies are disposed in a vehicle width direction, and each of the lamp bodies is disposed so that an extension direction of the first reflective surface is parallel to the vehicle width direction.

10. The lamp body according to claim 1, further comprising an annular cover member that is fitted to the lens body from the front side and covers the outer peripheral portion of the lens main body and the fixing portions.

11. The lamp body according to claim 10, wherein the cover member comprises a cover body that overlaps the first reflective surface and covers at least a part of the first reflective surface.

12. The lamp body according to claim 11, wherein the cover body is formed in the shape of a protrusion that protrudes toward a middle portion of the lens main body and is directed to the middle portion.

13. A vehicle lamp body unit comprising a plurality of the lamp bodies according to claim 12, wherein a plurality of the lamp bodies are disposed in a vehicle width direction, and each of the lamp bodies is disposed so that an extension direction of the first reflective surface is parallel to the vehicle width direction.

14. A vehicle lamp body unit comprising a plurality of the lamp bodies according to claim 11, wherein a plurality of the lamp bodies are disposed in a vehicle width direction, and each of the lamp bodies is disposed so that an extension direction of the first reflective surface is parallel to the vehicle width direction.

15. A vehicle lamp body unit comprising a plurality of the lamp bodies according to claim 10, wherein a plurality of the lamp bodies are disposed in a vehicle width direction, and each of the lamp bodies is disposed so that an extension direction of the first reflective surface is parallel to the vehicle width direction.

16. A vehicle lamp body unit comprising a plurality of the lamp bodies according to claim 1, wherein a plurality of the lamp bodies are disposed in a vehicle width direction, and each of the lamp bodies is disposed so that an extension direction of the first reflective surface is parallel to the vehicle width direction.

* * * * *